US006393883B1

(12) United States Patent
Freck

(10) Patent No.: US 6,393,883 B1
(45) **Date of Patent: *May 28, 2002**

(54) TUBULAR KEYED CAM LOCK WITH SCREW ATTACHMENT

(75) Inventor: Lawrence L. Freck, Carol Stream, IL (US)

(73) Assignee: Royal Lock Corp., Wauconda, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/518,152

(22) Filed: Mar. 2, 2000

(51) Int. Cl.[7] ..... E25B 17/18

(52) U.S. Cl. ..... 70/491; 70/375; 70/455

(58) Field of Search ..... 70/491, 492, 423, 70/427, 455, 370, 373, 381, 449, 452, 372, 375, 379

(56) References Cited

U.S. PATENT DOCUMENTS

| | | | | |
|---|---|---|---|---|
| 1,968,555 | A | 7/1934 | Horne | 70/46 |
| 2,580,882 | A | 1/1952 | Blohm | 70/340 |
| 3,303,678 | A | 2/1967 | Bernard et al. | 70/373 |
| 3,336,774 | A | 8/1967 | Gray et al. | 70/367 |
| 3,367,155 | A | 2/1968 | Kobrehel | 70/366 |
| 3,454,320 | A | 7/1969 | Olree | 312/217 |
| 3,477,775 | A | 11/1969 | Trent | 312/209 |
| 3,600,914 | A | 8/1971 | Johnson et al. | 70/72 |
| 3,705,508 | A | 12/1972 | Fritsch et al. | 70/373 |
| 3,741,619 | A | 6/1973 | Dyer et al. | |
| 3,774,985 | A | 11/1973 | Chovanec et al. | 312/217 |
| 3,863,476 | A | 2/1975 | Patriquin | 70/419 |
| 3,952,565 | A | 4/1976 | Falk | 70/417 |
| 4,006,616 | A | 2/1977 | Rubner et al. | 70/455 |
| 4,047,407 | A | 9/1977 | Aranzabal | 70/52 |
| 4,099,398 | A | 7/1978 | Lipschutz | 70/406 |
| 4,121,864 | A | 10/1978 | Kagoura | 292/202 |
| 4,239,309 | A | 12/1980 | De Fouw et al. | 312/221 |
| 4,290,279 | A | 9/1981 | Fish et al. | 70/38 A |
| 4,385,551 | A | 5/1983 | Zboralski | 98/115 LH |
| 4,425,770 | A | 1/1984 | Mentani et al. | 70/252 |
| 4,452,498 | A | 6/1984 | Wood, Jr. et al. | 312/216 |
| 4,583,775 | A | 4/1986 | Bisbing | 292/64 |
| 4,637,667 | A | 1/1987 | Reid et al. | 312/217 |
| 4,712,201 | A | 12/1987 | Craig | 70/369 |
| 4,732,434 | A | 3/1988 | Hartrum | 312/221 |
| 4,815,304 | A | 3/1989 | Kesselman | 70/34 |
| 4,829,887 | A | 5/1989 | Holschbach | 98/115.3 |
| 4,865,248 | A | 9/1989 | Barth | 232/24 |
| 5,038,589 | A | 8/1991 | Martin | 70/368 |
| 5,199,282 | A | 4/1993 | Wang | 70/38 A |
| 5,199,285 | A | 4/1993 | Lin | 70/220 |
| 5,234,236 | A | 8/1993 | Gromotka | 292/194 |
| 5,235,832 | A | 8/1993 | Lux et al. | 70/214 |
| 5,249,443 | A | 10/1993 | Anderson | 70/370 |
| 5,251,467 | A | 10/1993 | Anderson | 70/370 |
| 5,265,455 | A | 11/1993 | Grimmer | 70/492 |
| D352,887 | S | 11/1994 | Schlack | D8/343 |
| 5,491,993 | A | 2/1996 | Anderson | 70/367 |
| 5,626,041 | A | 5/1997 | Zaccaria | 70/370 |
| 5,634,359 | A | 6/1997 | Huebschen | 70/379 R |
| 5,678,437 | A | 10/1997 | Walla | 70/370 |
| 5,678,438 | A | 10/1997 | Kolkman et al. | 79/370 |
| 5,724,840 | A | 3/1998 | DiVito | 70/371 |

*Primary Examiner*—Yonel Beaulieu
(74) *Attorney, Agent, or Firm*—Michael Best & Friedrich LLC

(57) ABSTRACT

The present invention provides a tubular keyed cam lock with increased resistance to tampering. The cam lock has a rear screw which attaches the cam to the rotatable cam of the lock, thereby increasing the strength of the lock by preventing the lock from being pried off. The lock includes a plug body with a key entering end and a cam actuating end, a plurality of spring biased pin tumblers engaging the key when the key is inserted into the plug body and a lock housing within which the plug body is rotatably positioned. The lock housing has at least one limit stop disposed thereon. As discussed above, the cam-actuating end of the plug body is connected with a screw to a metal stop plate.

17 Claims, 1 Drawing Sheet

TUBULAR KEYED CAM LOCK WITH SCREW ATTACHMENT

BACKGROUND OF THE INVENTION

This invention generally relates to locks, and, more particularly, to tubular key actuated cam locks. Locks generally are subject to extensive efforts to defeat their defenses. A lock's design and the materials used to manufacture the lock determine the lock's strength and resistance to tampering. Tubular keyed cam locks provide additional security due the fact that the circular key is more difficult to pick than conventional tumbler locks. However, conventional tubular key-actuated cam locks use a diecast spindle or brass spindle protruding from the back of the cam lock to affix the rotatable cam to the cam mechanism. Such an arrangement can be defeated by applying enough pressure to the front or back of the lock to break the spindle, thereby prying off the lock.

Exemplary locks are disclosed in U.S. Pat. Nos. 4,006,616; 4,070,844; 4,099,398; 4,208,894; 4,425,770; 4,648,483; 4,674,777; 4,715,201; 4,830,168; 5,038,589; 5,152,161; 5,199,285; 5,251,467; 5,265,455; 5,678,438; 5,724,840; and 5,868,060. All of these devices have a number of drawbacks and, as such, provide limited security. It is an object of the present invention to solve the problems enumerated above.

SUMMARY OF THE INVENTION

The present invention provides a tubular keyed cam lock. The tubular cam lock has a rear screw attachment to the back end of the cam lock which affixes the cam to the back of the lock. As disclosed herein, the lock includes a plug body rotatably mounted inside a lock housing. The lock housing includes a plug cap with an opening permitting the entry of the key. The plug body has a key entering end and a cam actuating end, and a plurality of spring biased pin tumblers engaging the key when the key is inserted into the plug body. A rear screw attachment affixes the cam to the plug body. The lock housing has at least one limit stop disposed thereon.

It is the primary object of the present invention to increase the level of security associated with the use of tubular keyed cam locks in keyed applications, and to thereby reduce the unauthorized access to items secured by tubular keyed cam locks in conditions prone to tampering.

It is an additional object of the present invention to provide a tubular keyed cam lock which can be manufactured using existing techniques and machinery which has increased security.

The objects and features of the present invention, other than those specifically set forth above, will become apparent in the detailed description of the invention and drawings set forth below.

DETAILED DESCRIPTION OF THE INVENTION

Figure 1:
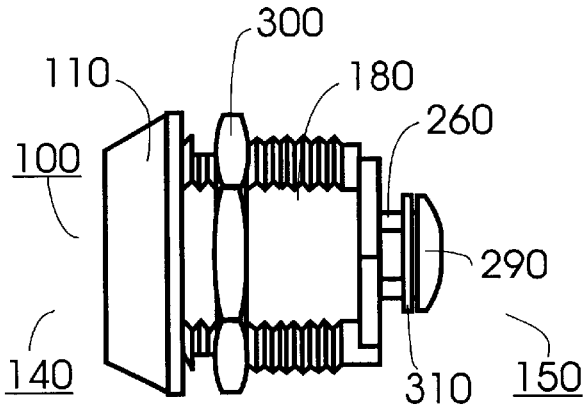
FIG. 1 is a side planar view of the tubular keyed cam lock of the present invention.
Figure 2:
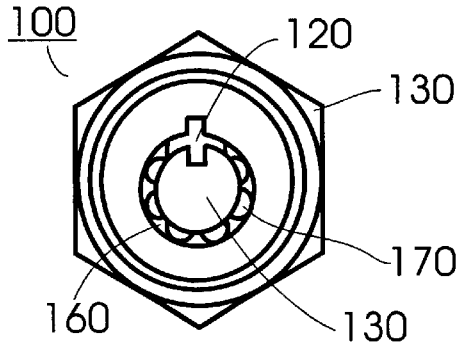
FIG. 2 is a front planar view of the tubular keyed cam lock of FIG. 1.
Figure 3:
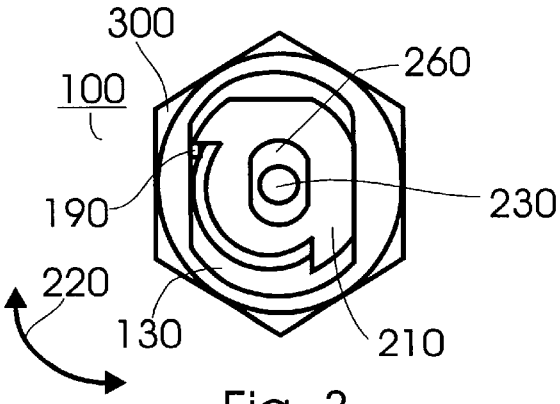
FIG. 3 is a rear planar view of the tubular keyed cam lock of FIG. 1.

FIGS. 1 through 4 depict the preferred embodiment of the tubular keyed cam lock 100 disclosed in the present application. An exploded perspective view of tubular keyed cam lock of FIGS. 1 through 3 is provided in FIG. 4.

Figure 6:
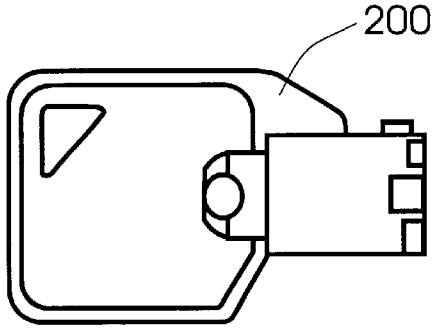
FIG. 6 is a side view of a key suitable for use with the tubular keyed cam lock of FIG. 1.

As seen in FIGS. 1 through 4, plug cap 110 has an opening 120 permitting the entry of key 200 (as shown in FIG. 6) through plug cap 110 and into plug body 130. Plug body 130 is disposed adjacent to and in back of plug cap 110. Plug body 130 has key entering end 140 and cam actuating end 150. Plug body 130 is preferably adapted to receive tubular key 200 (as shown in FIG. 6). Between key entering end 140 and cam actuating end 150 on plug body 130, are a plurality of spring actuated bias pin tumblers 170. Plug body 130 has apertures 160 as required to accommodate spring actuated pin tumblers 170. Pin tumblers 170 engage key 200 (as shown in FIG. 6) when key 200 (as shown in FIG. 6) is inserted into plug body 130 and either open or close (lock) the tubular keyed cam lock 100 as required.

As seen in FIG. 3, plug body 130 is disposed and rotatably positioned in a threaded lock housing 180. As best depicted in FIG. 3, lock housing 180 has at least one limit stop 190 at the cam actuating end 150 of lock housing 130. Alternatively, additional limit stops (not shown) are disposed on cam actuating end 150 to permit stop plate 210 to rotate through a predetermined range of motion 220.

Figure 4:
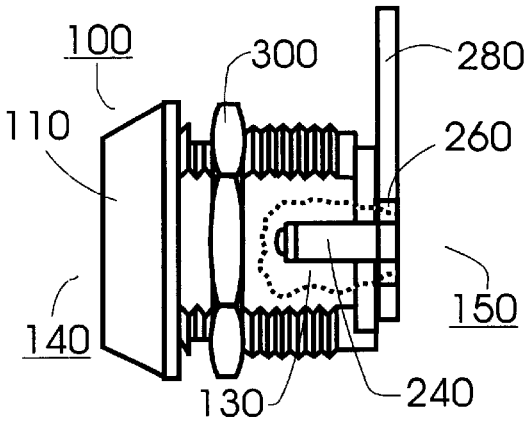
FIG. 4 is a side partially-cut-away sectional planar view of FIG. 1, including a portion of the interior of the tubular keyed cam lock of FIG. 1, including a rotatable cam.
Figure 5:
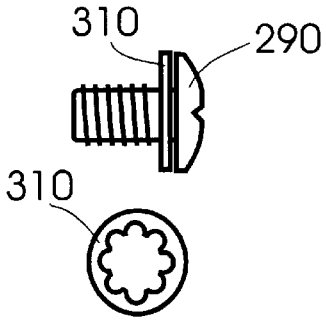
FIG. 5 is a side view of the rear screw and washer used in connection with the tubular keyed cam lock of FIG. 1, and a front view of the washer used in connection with the rear screw.

As best depicted in FIG. 4, a threaded aperture 230 is located on internal screw-matable portion 240 of plug body 130. Threaded aperture 230 is sized, positioned, constructed and arranged for threaded insertion of a rear screw 250 (as seen in FIG. 5) into aperture 230 of internal screw-matable portion 240 of plug body 130.

Plug body 130 includes a cam actuator 260 at the cam actuating end 150 of the tubular cam lock 100 disclosed. Cam actuator 260 is a rectangular shape or other appropriate geometric shape for actuating and interfacing with stop plate 270 and cam 280 (as seen in FIG. 4). Aperture 230 of internal screw-matable portion 240 of plug body 130 threads complementary to receive rear screw 290 (as seen in FIG. 5). Rear screw 290 secures the stop plate 270 and cam 280 to plug body 130.

As best depicted in FIGS. 1 and 3, a complementary threaded nut 300, capable of engaging and mating with housing 180, is used to securably mount the tubular keyed cam lock 100 to the surface to which the lock 100 is being attached. The surface (not shown) fits between body nut 300 and lock housing 180. Threaded nut 300 is a hex nut as illustrated in FIGS. 1 though 4. Alternatively, threaded nut 300 could be replaced with a spring clip (not shown).

The invention also provides a method of manufacturing a tubular keyed cam lock 100. The method includes assembling plug cap 110, plug body 130, pin tumblers 180, lock housing 180, metal stop plate 260, and rotatable cam 280. Specifically, the method includes providing tubular keyed cam lock 100 and affixing the rotatable cam 280 mated to the cam actuator 260 on the cam actuating end 150 using a rear screw 290 to obtain a tubular key actuated cam lock 100 with increased resistance to tampering.

Applicant's invention, method of manufacture described herein and the combination of preferred components of tubular keyed cam lock 100 results in a tubular key actuated cam lock 100 with an increased level of security in comparison to conventional tubular keyed cam locks. The increased level of security is achieved through utilization of a rear screw 290 to attach the cam 280 to the cam actuating end 150 of the housing body 130. The rear screw 290 increases the strength of the apparatus and thereby minimizes the possibility of the cam lock 100 being defeated. As embodied herein, the Applicant's tubular keyed cam lock 100 can withstand prying force/pressure pressure equal to the tensile strength of the rear threaded fastener 290 prior to of the rear screw 290. Preferably, a washer 310 is included between the cam 280 and the aperture 230 of internal screw-matable portion 240 of plug body 130.

In an alternative embodiment, rear screw 290 could be replaced with any suitable threaded fastener such as a bolt (not shown).

It is appreciated that one or more of the components of tubular keyed cam lock 100 are made of various types of corrosion resistant metals. The corrosion resistant metals are selected from the group consisting of stainless steel and brass, but other alloys are contemplated to be used therein.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. A tubular keyed cam lock for locking against a surface comprising:

a lock housing; said lock housing having at least one limit stop disposed thereon;

a plug cap; said plug cap having an opening permitting the entry of a key;

a plug body disposed adjacent to said plug cap, said plug body being rotatably positioned within said lock housing, said plug body further having a key entering end and a cam actuating end; said plug body further having a plurality of spring biased pin tumblers engaging said key when said key is inserted into said plug body;

a stop plate connected to said cam actuating end of said plug body, said stop plate being constructed and arranged to engage said limit stop when said plug body is rotated;

a rotatable cam connected to said cam actuating end for selectively locking said tubular cam keyed cam lock relative to said surface; and a threaded fastener affixing said rotatable cam to said cam actuating end.

2. The tubular keyed cam lock for locking against a surface of claim 1 wherein said threaded fastener is a threaded screw.

3. The tubular keyed cam lock of claim 1 wherein said threaded fastener is a threaded bolt.

4. The tubular keyed cam lock of claim 1 in which said plug body is threaded for acceptance of a threaded nut.

5. The tubular keyed cam lock of claim 1 in which tubular keyed cam lock further includes a threaded nut rotatably mounted to said plug body.

6. The tubular keyed cam lock of claim 5 in which said tubular keyed cam lock is suitable for mounting to a surface by positioning said surface between said plug cap and said threaded nut.

7. The tubular keyed cam lock of claim 5 in which said threaded nut is a hex nut.

8. The cam lock of claim 1 in which said plug body is adapted to receive tubular key.

9. The tubular keyed cam lock of claim 1 in which one or more portions of said cam lock are manufactured from a corrosion resistant metal.

10. A method of creating a tubular keyed cam lock for locking against a surface, comprising:

assembling a cam lock from the group of following components a plug cap, said plug cap including an opening permitting the entry of a key, a plug body, said plug body having a key entering end and a cam actuating end, spring pin tumblers, a lock housing, a threaded nut, metal stop plate, and a rotatable cam; and affixing said rotatable cam to said cam actuating end using a threaded fastener.

11. The method of creating a keyed cam lock of claim 10 wherein said threaded nut comprises a spring clip.

12. The method of creating a keyed cam lock of claim 10 wherein said threaded fastener comprises a threaded screw.

13. The method of creating a keyed cam lock of claim 10 wherein said threaded fastener comprises a threaded bolt.

14. The method of creating a keyed cam lock of claim 10 further comprising the additional step of providing a washer between said threaded fastener and said cam actuating end.

15. The tubular keyed cam lock of claim 1 in which said tubular keyed cam lock can withstand pressure equal to the tensile strength of said rear threaded fastener prior to failure of said tubular keyed cam lock.

16. The tubular keyed cam lock of claim 1 in which said threaded nut is a spring clip.

17. A tubular keyed cam lock for locking against a surface comprising:

a lock housing; said housing having an opening permitting the entry of a key;

a plug body rotatably positioned within said lock housing, said plug body having a key entering end and a cam actuating end; said plug body further having means for engaging said key when said key is inserted into said plug body;

a rotatable cam connected to said cam actuating end for selectively securing said tubular cam keyed cam lock relative to said surface; and a threaded fastener affixing said rotatable cam to said cam actuating end.

* * * * *